US005960623A

United States Patent [19]

Legrom

[11] Patent Number: 5,960,623

[45] Date of Patent: Oct. 5, 1999

[54] SIDE DISC FOR THE SUPPORT DISC BEARING OF A ROTOR SPINNING DEVICE

[76] Inventor: Friedrich Legrom, Hauenstrasse 6, D-71540 Murrhardt, Germany

[21] Appl. No.: 09/175,944

[22] Filed: Oct. 21, 1998

[30] Foreign Application Priority Data

Apr. 2, 1998 [DE] Germany ..... 298 06 031

[51] Int. Cl.[6] ..... D01H 4/00

[52] U.S. Cl. ..... 57/406; 57/263

[58] Field of Search ..... 57/263, 404, 406

[56] References Cited

U.S. PATENT DOCUMENTS

| | | | |
|---|---|---|---|
| 4,890,492 | 1/1990 | Raasch | 57/406 |
| 5,362,160 | 11/1994 | Braun et al. | 57/406 |
| 5,509,262 | 4/1996 | Stahlecker | 57/264 |
| 5,675,964 | 10/1997 | Stahlecker | 57/406 |
| 5,799,478 | 9/1998 | Legrom | 57/406 |

FOREIGN PATENT DOCUMENTS

| | | | |
|---|---|---|---|
| 4121387 | 1/1993 | Germany . | |
| 9314801 | 2/1994 | Germany . | |
| 4229154 | 3/1994 | Germany | 57/406 |
| 4313753 | 11/1994 | Germany . | |
| 19620377 | 11/1997 | Germany . | |

*Primary Examiner*—William Stryjewski
*Attorney, Agent, or Firm*—Paul Vincent

[57] ABSTRACT

A side disc (2) for axial introduction onto a support disc (1) for a support disc bearing of the rotor of an open-ended rotor spinning machine having at least one reflecting region on the side of the side disc (2) facing a light source which is being otherwise substantially non-reflecting, wherein the reflecting region in the side disc (2) has one or more reflectors (3) worked into the side disc, is characterized in that the side disc (2) is made from injection moulded transparent and preferentially colourless plastic, and the reflectors (3) are fashioned on the side of the side disc (2) facing away from the light source in a form of cats-eye structures, and the region of the formed reflectors (3) is stepped-back with respect to other portions of the side of the side disc (2) facing away from the light source, and a fitted member (5) is provided for which is mounted into a recess (6) of the side disc (2) containing the reflector (3) and which completely covers, in a dust-tight manner, the region of the corresponding reflector (3) on the side of the side disc (2) facing away from the light source. In this fashion, the required exchange of the side or support disc resulting from decreasing reflectivity of the reflector is avoided.

19 Claims, 1 Drawing Sheet

SIDE DISC FOR THE SUPPORT DISC BEARING OF A ROTOR SPINNING DEVICE

This application claims Paris Convention Priority of German Utility Application Number 298 06 031.0 filed Apr. 2, 1998, the complete disclosure of which is hereby incorporated by reference.

BACKGROUND OF THE INVENTION

The invention concerns a side disc for axial introduction onto a support disc for a support disc bearing of the rotor of an open ended rotor spinning machine for the optical control of a joining carriage, wherein an interruption of a rotational motion of the support disc about a rotational axis is optically recognized by the joining carriage and a working program for the joining carriage is initiated, with at least one reflecting region of the side of the side disc on the support disc facing a light source but otherwise substantially non-reflecting, wherein the reflecting region in the side disc has one or more reflectors worked into the side disc.

A side disc of this type is e.g. known in the art from DE 41 21 387 A1.

Support discs are used in textile machines to control so-called joining carriages which join torn threads to once more bring this spinning location into operation. A pair of parallel adjacent shafts are driven within the spinning device on each axial end of which a so-called support disc (i.e. a total of four support discs) is disposed. One of these four support discs has reflectors on an outwardly directed side facing a light source, e.g. a laser beam. A portion of the light from the light source is reflected by the reflector and is incident on a measuring device e.g. a photocell so that the photocell receives a portion of the light reflected by the reflector in dependence on the rotational frequency of the support disc. The photocurrent in the photocell is modulated with the rotational frequency of the running disc. If one single reflector is mounted on the disc surface, the modulation frequency corresponds exactly to the rotational frequency of the support disc whereas, with a plurality of reflectors on the disc surface, the modulation frequency is a multiple of the rotational frequency corresponding to the number of reflectors. Should the open-ended spinning machine malfunction, e.g. due to a torn thread, the support discs are no longer driven so that the support disc having the reflectors rotates more slowly until it stops. This decrease in the rotational frequency leads to a corresponding decrease in the modulation frequency of the photocurrent which is seen as a malfunction, e.g. a torn thread, by a suitable control electronics. When the support disc is stationary, a constant photocurrent is imparted to the photocell.

A support disc for the support disc bearing of an open-ended spinner rotor is known in the art from DE 43 13 753 A1 with which the occurence of a malfunction is indicated using a magnetic field line signal generator instead of an optical signal generator, e.g. a pin worked into the support disc and made from a ferromagnetic material.

A support disc is known in the art from DE 93 14 801 U1 with which an optical reflector made from light thin foil is adhesively attached to the surface for indication of malfunction. When the surface becomes worn, the reflector can be replaced by glueing a new component thereon.

These conventional support discs have reflector zones configured in such a fashion that a thin ring-shaped plastic disc having reflecting sections is introduced into the side of the disc facing the light source. These reflecting sectors are ring-shaped and consist generally of aluminum with a mirrored surface which is pressed in a interlocking fashion in corresponding ring-shaped segments within the plastic disc. The plastic disc is introduced into the disc surface in a manner which is resistant to twisting in that axially protruding clamping members of the plastic discs are clamped into corresponding receptacles in the disc surface.

Finally known in the art from the above mentioned DE 41 21 387 A1 is a support disc with which optical reflector zones are configured for indication of malfunction by inserting a thin ring-shaped side disc made from plastic and having reflecting sectors into the side of the support disc facing the light source. Since the conventional reflecting side disc can only be acquired in a modular form it is correspondingly expensive. In addition, it is easily broken, since pressure must be exerted to press the side disc into and out of the disc surface of the support disc.

In the environment of an operating rotor spinning machine, the air is filled with soiling particles such as oil, petroleum benzine, dust and in particular so-called "fly" (fine and extremely fine fiber fragments). Over a period of time, this soilage deposits on and around the side disc. Since the side discs in accordance with DE 41 21 387 A1 are not introduced onto the support disc in a dust-tight fashion, the soilage slowly gains entrance between the side disc and the reflector zone which, over a period of time, strongly reduces the reflectivity. Since the conventional reflecting side discs are built in a modular fashion, removal of the deposited soilage is not possible so that a new reflecting side disc must be introduced into the running disc. If, however, the reflector changes, the production process is substantially encroached upon at this location. In addition, the reflecting plastic disc is normally firmly connected to the support disc (e.g. by glueing) to prevent twisting with respect thereto so that the entire support disc must be exchanged if soilage occurs.

Known in the art from DE 196 02 377 A1 is a support disc having reflectors for open-ended rotor spinning machines with which, in contrast to the side disc in accordance with the invention, circular reflector elements are directly inserted in corresponding depressions on the support disc. Towards this end, among other things, a reflector element is provided for which likewise has a cats-eye structure directly formed on its side facing away from the light source. A covering member is, however, in contrast to the side disc in accordance with the invention, not provided for so that the above mentioned soilage problem is not permanently solved. This is also the case in the other prior art.

It is therefore the purpose of the present invention to further improve a side disc of the above mentioned kind such that the above-mentioned disadvantages of conventional side discs having reflectors, in particular the necessary exchange of the side discs or the support discs due to loss of reflectivity, is avoided.

SUMMARY OF THE INVENTION

This purpose is achieved in accordance with the invention in that the side disc is injection moulded from transparent, and preferentially colourless plastic, and the reflectors are fashioned on the side of the side disc facing away from the light source in the form of cats-eye structures, and the region of the fashioned reflectors is stepped-back relative to other portions of the side of the side disc facing away from the light source and a fitted member is provided for which is attached into the opening of the side disc containing the reflector and completely covers, in a dust-sealed manner, the region of the corresponding reflector on the side of the side disc facing away from the light source.

In this fashion an exchange of the sensitive and expensive side disc or of the entire support disc is no longer necessary or is only necessary after a very long operation period or as a result of damage by external forces, since a loss in reflection of the reflectors due to the all-present soilage surrounding a rotor spinning machine no longer occurs. Possible soilage deposits on the side facing the light source can be easily wiped-off using a cloth. The reflector zone is then once more completely functionable.

In a particularly preferred embodiment of the side disc in accordance with the invention, the fitted member has a edge-shape at the side facing the reflector which exactly matches the edge-shape of the opening containing the reflector. In this manner, the formed cats-eye structure is completely sealed-off towards the outside when the fitted member is inserted into the recess.

In an advantageous improvement, the fitted member has a radially protruding edge on its side facing away from the reflector. In this manner, a wide area support of the fitted member on the side disc is effected. This improves the mounting.

In a particularly preferred improvement, the protruding edge of the fitted member extends around the entire girth so that a particularly high sealing effect results when the fitted member is pressed on due to the wide area seating of the fitted member on the side disc to effect perfect dust protection for the reflector.

A further particularly preferred embodiment of the side disc in accordance with the invention provides that the fitted member has a non-transparent, preferentially mirrored surface on its side facing the reflector. In this manner, the reflective properties of the reflector are further improved so that even in the event that some soilage collects on the side of the side disc facing the light source, immediate cleaning steps are not required to guarantee functionability.

A less expensive improvement of this embodiment provides that the fitted member is made from metal, preferentially from sheet metal.

Alternatively, the fitted member can be made from injection moulded plastic, in particular from the same plastic as the side disc.

An improvement of this embodiment is preferred with which the fitted member is made from a coloured plastic. In this fashion, the reflector region is prominently coloured towards the outside upon an otherwise colourless side disc.

In particularly simple embodiments, the fitted member is clipped or clamped into the recess in the side disc. In this manner, a particularly simple assembly of the fitted member results which substantially reduces the mass production costs of the side disc.

In other embodiments, the fitted member can be glued to the side disc to effect an absolute dust sealing, and possibly also a water-tight sealing of the reflector encapsulated with the assistance of the fitted member.

An additional possibility for assembling the fitted member into the side disc is the use of a heat-welding procedure, wherein the fitted member consists essentially of a plastic material which melts at a non-excessive temperature. In this event, the fitted member and the side disc are preferentially made from exactly the same material.

Highly preferred is, however, a variation with which the fitted member is welded to the side disc using ultrasound weldment. In this case as well, the fitted member and the side disc preferentially consist essentially of the same plastic material. In contrast to a heated weldment, the ultrasound weldment does not lead to an undesirable deformation of the processed pieces. After the ultrasound welding procedure has ended, the reflector is then absolutely sealed-off not only with respect to dust, but also with respect to all possible chemicals acting from the outside.

The reflector and the fitted member of the side disc in accordance with the invention are fashioned with a substantially ring sector shape with the side disc normally having a circular ring shape.

A particularly preferred improvement of this embodiment has the linear side borders of the ring sectors protruding outwardly in a V-shaped fashion. This special geometry facilitates a particularly strong and non-slipping mounting of the fitted member following introduction into the corresponding recess of the side disc which preferentially has the same edge shape.

An embodiment is also particularly preferred with which the reflector has a mirrored, (preferentially evaporated metal) surface at its side facing the support disc to achieve the best possible reflection properties for the cats-eye structure. The capsuling-off of the reflector in accordance with the invention by the fitted member does away with the need for mirroring the reflector since, due to the guaranteed prevention of soiling, a somewhat reduced degree of reflection is sufficient.

It is additionally advantageous when the support disc is surrounded by a non-reflecting, preferentially black ring jacket. This facilitates particularly easy adjustment of the light source relative to the support disc. In addition, the optimal utilization of the reflecting light itself prevents the need for immediate cleaning when the reflecting region directed towards the light source is somewhat dusty or soiled. This postpones expensive interruptions in operation to as long an extent as possible.

Further advantages of the invention can be derived from the description and the drawing. The above mentioned features and those to be further described below can be utilized in accordance with the invention individually or collectively in arbitrary combination. The embodiments shown and described are not to be considered exhaustive enumeration, rather have exemplary character only for illustration of the invention.

The invention is illustrated in the drawing and will be further described with reference to the embodiment.

DESCRIPTION OF THE PREFERRED EMBODIMENT

Figure 1:
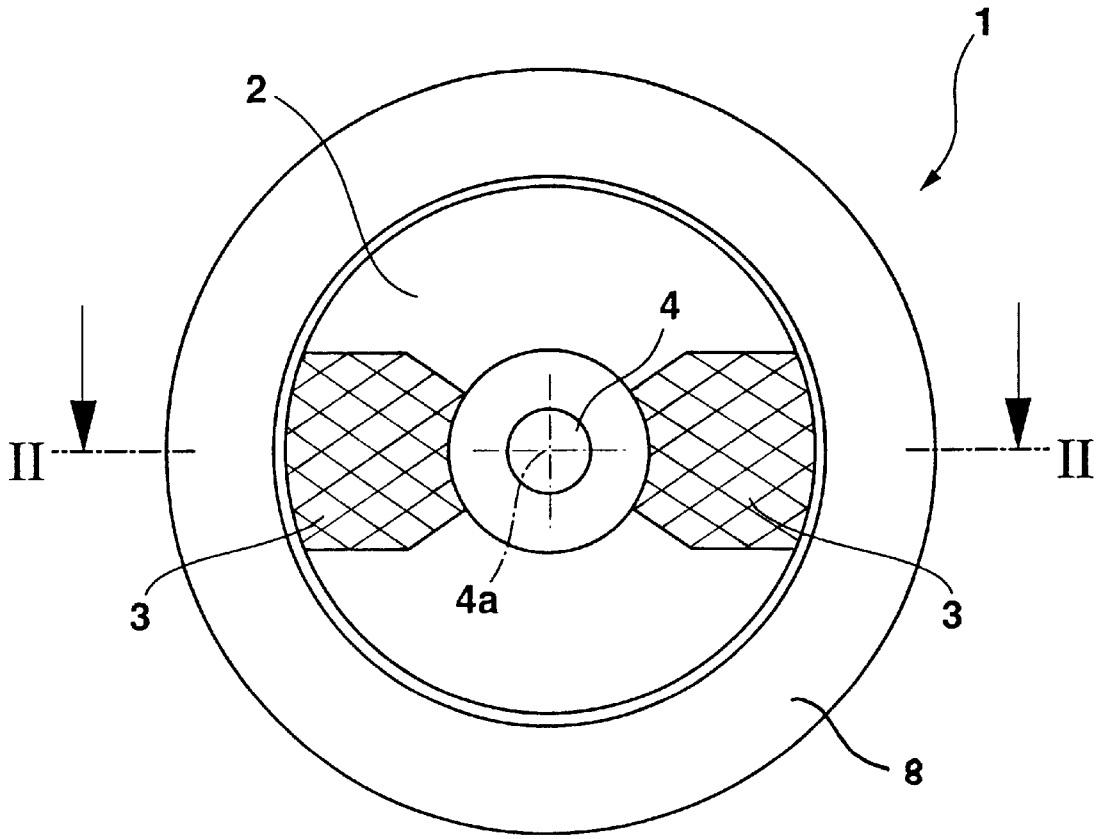
FIG. 1 shows a front view of a side of a support disc facing a light source having an embodiment of the side disc in accordance with the invention mounted thereon.

FIG. 1 shows a support disc 1 with a side surface 2 having two reflectors 3 mounted diametrically across with respect to a rotational axis 4*a* at the side of the support disc facing a light source in the installed state. The support disc 1 has a central bore hole 4 through which a shaft is guided in the installed state.

Figure 2:
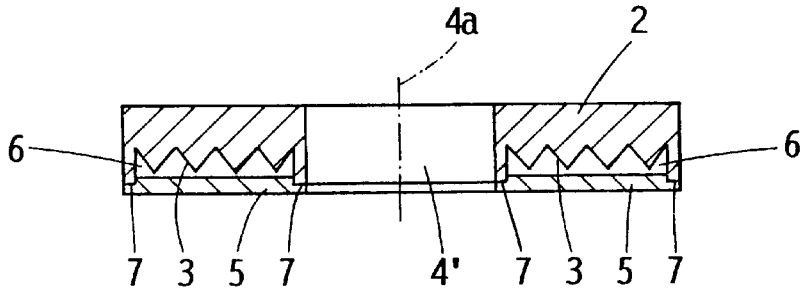
FIG. 2 shows a cross section through the side disc according to FIG. 1 along the cut line II—II.

As can be seen from FIG. 2, the reflectors 3 are formed as cats-eye structures on the side of the side disc 2 facing away from the light source. The portion of the formed reflectors 3 is stepped-off with respect to other portions of the side of the side disc 2 facing away from the light source.

In order to seal and capsule-off the reflectors 3 with respect to dust and also possibly with respect to fluids, a fitted member 5 is provided for in each case having an edge shape on its side facing the reflector 3 which exactly follows the edge shape of the opening in the side disc 2 containing the reflector 3 and which completely covers the reflector 3.

The fitted member 5 has a radial protrusion on its side facing away from the reflector 3 which extends about the entire girth edge 7 and with which the fitted member is supported against the side disc 2 over a wide area.

The fitted member 5 can simply be clipped or clamped into the recess 6 of the side disc 2. It could also be glued to the side disc 2. However, an ultrasound welding of the fitted member 5 with the side disc 2 is preferred, wherein the fitted member 5 and the side disc 2 should both be made from the same plastic material.

In the event of mechanical attachment or glueing, the fitted member 5 can also be made from metal. In particular, it can also have a non-transparent, preferentially mirrored surface on its side facing the reflector 3.

The shape of the reflectors 3 and of the fitted members 5 is substantially arbitrary. Ring sector-shaped configurations have proven, however, to be particularly advantageous, wherein the side border of the ring sectors can protrude outwardly in a V-shaped fashion.

In order to increase the reflectivity, the reflector 3 can be mirrored, e.g. through metallic evaporation on its surface facing the support disc 1 or the fitted member 5.

The outer region the support disc 1 is covered with a substantially U-shaped black ring jacket 8. This non-reflecting ring jacket 8 facilitates an easy alignment of the reflected light source relative to the support disc 1.

I claim:

1. A side disc to optically control a joining carriage of an open-ended rotor spinning machine, wherein an interruption in a rotational motion of the side disc about a rotational axis is optically recognized by the joining carriage by sensing light from a light source reflected by the side disc to start a working program for the joining carriage, the side disc comprising:

a body consisting essentially of an injection moulded transparent plastic, said body having a recess fashioned in a first side of said body facing away from the light source;

a reflector member disposed within said recess to reflect light from said light source passing through said body; and a fitted member mounted in said recess to seal said reflector in a dust-tight manner.

2. The side disc of claim 1, wherein said fitted member has an edge shape at a side facing said reflector which corresponds exactly to an edge shape of said recess.

3. The side disc of claim 1, wherein said fitted member has a radially protruding edge at a side facing away from said reflector.

4. The side disc of claim 3, wherein said protruding edge extends around an entire girth of said fitted member.

5. The side disc of claim 1, wherein said fitted member has a non-transparent surface at a side facing said reflector.

6. The side disc of claim 5, wherein said non-transparent surface is mirrored.

7. The side disc of claim 1, wherein said fitted member consists essentially of metal.

8. The side disc of claim 1, wherein said fitted member consists essentially of injection moulded plastic.

9. The side disc of claim 8, wherein said fitted member consists essentially of coloured plastic.

10. The side disc of claim 8, wherein said fitted member is ultrasound welded to said body.

11. The side disc of claim 8, wherein said fitted member is heat welded to said body.

12. The side disc of claim 1, wherein said fitted member is glued to said body.

13. The side disc of claim 1, wherein said fitted member is clipped into said recess.

14. The side disc of claim 1, wherein said reflector and said fitted member are shaped as a section of a ring.

15. The side disc of claim 14, wherein said section of a ring has a substantially V-shaped outer edge.

16. The side disc of claim 1, wherein said reflector is mirrored at a surface facing the light source.

17. The side disc of claim 16, wherein said mirrored surface is metallically evaporated.

18. The side disc of claim 1, wherein said reflector comprises a plurality of reflecting surfaces having substantially V-shaped cross sections.

19. The side disc of claim 1, wherein said reflector comprises a plurality of reflecting surfaces having substantially V-shaped cross sections at a side of the side disc facing away from the light source.

* * * * *